United States Patent [19]

Volpert et al.

[11] Patent Number: 4,557,956

[45] Date of Patent: Dec. 10, 1985

[54] DEFORMABLE CONTAINER WITH FILLER UNIT

[75] Inventors: Fritz Volpert; Hans-Werner Stöcker, both of Bad Berleburg, Fed. Rep. of Germany

[73] Assignee: Luwa AG, Zürich, Switzerland

[21] Appl. No.: 563,743

[22] Filed: Dec. 21, 1983

[30] Foreign Application Priority Data

Dec. 23, 1982 [DE] Fed. Rep. of Germany ..... 3247759

[51] Int. Cl.[4] ..... B65D 37/00; B65D 7/46

[52] U.S. Cl. ..... 428/35; 206/522; 220/438; 383/108; 383/120

[58] Field of Search ..... 206/522; 428/35, 182; 383/108, 120; 220/438

[56] References Cited

U.S. PATENT DOCUMENTS

| | | | |
|---|---|---|---|
| 3,266,532 | 8/1966 | Stewart | 222/209 |
| 3,559,708 | 2/1971 | Wood | 383/120 |
| 4,164,970 | 8/1979 | Jordan | 206/522 |
| 4,187,845 | 2/1980 | Dror | 222/209 |
| 4,309,466 | 1/1982 | Stillman | 428/35 |
| 4,330,072 | 5/1982 | Mastman | 222/209 |

*Primary Examiner*—Christopher A. Henderson
*Attorney, Agent, or Firm*—Spencer & Frank

[57] ABSTRACT

A container made of deformable sheet material comprises two panels generally facing one another and having perimetric edge zones bonded fluidtight to one another. In at least one of the panels deformation-enhancing corrugations are provided whereby the container is expandable from a flat state into an inflated state. The container may have a filler unit which comprises a tubular nipple attached to the container; a closure cap received on an outer end of the tubular nipple; a collar attached to the inner circumferential surface of the tubular nipple at an end thereof oriented towards the container; a breakable closure disc extending across the flow passage and having a circumferential edge zone in engagement with the collar; and an inner ring threadedly engaging the inner circumferential surface of the tubular nipple and pressing the breakable closure disc against the collar.

4 Claims, 8 Drawing Figures

DEFORMABLE CONTAINER WITH FILLER UNIT

BACKGROUND OF THE INVENTION

This invention relates to a deformable container, particularly a diposable container, preferably made of a material which is deformable at ambient temperatures.

In the food, beverage and pharmaceutical industry liquids, powders, or otherwise flowable materials have to be packaged in sterilizable containers for storage and shipment. Since the prescribed conditions of sterilization often do not permit the container to be re-used, throwaway (disposable) containers have to be used despite the high costs involved. In case containers having a capacity of, for example, 100 liters and more are used, significant additional expenses are involved concerning the transportation from the container manufacturer to the manufacturer of goods because, although they may be of light weight, such containers require a significant shipping space. The same considerations apply for hauling away empty containers from the consumer.

SUMMARY OF THE INVENTION

It is an object of the invention to provide an improved container which is easily deformable to permit its storage and shipment in a collapsed state when empty, that is, prior to filling and, particularly, after emptying.

This object and others to become apparent as the specification progresses, are accomplished by the invention, according to which, briefly stated, the container comprises two panels bonded sealingly to one another along their edges; one of the panels is, preferably in an edge zone, provided with a filler unit and at least one of the panels has deformation-enhancing corrugations to provide for an accordion-like deformation of the panel to assume an outwardly bulging (inflated) or a substantially planar state.

A container according to the invention may be compressed, after emptying, to a quasi-planar configuration with a relatively small force particularly if the panel having the deformation-enhancing corrugations is made of a drawable stainless steel. As a result, the hauling away of empty containers involves a significantly lower cost than it has been the case heretofore.

It is a particular advantage of the invention that the container according to the invention is manufactured such that the panel (or panels) provided with deformation-enhancing corrugations is in a collapsed (flat) state and thus the container is shipped to the filling plant in the collapsed condition. Prior to filling, the container is first expanded (inflated) by a pressurized fluid such as air, vapor or liquid introduced into the container. The pressurized fluid expands the container to its operative volume, and thereafter the container is filled with the product. It is conceivable, however, to use the product itself as the pressure medium. In case the container is made of metal, particularly drawable stainless steel, the container may be sterilized advantageously under hot temperature conditions, for example, by means of steam. In such a case the sterilization may be combined with the expansion (inflation) of the container because the steam for sterilization may be used at the same time as the inflating pressure fluid.

According to a further feature of the invention, the deformation-enhancing corrugations are arranged approximately parallel to the panel edges.

According to a further feature of the invention, the container is of square or rectangular outline and the deformation-enhancing corrugations are, in the collapsed state of the panel, deeper in the corner areas than in other zones of the panel. In this manner, in the corner zones there is a greater capacity for deformation so that upon expanding the container in the corner zones, the edges of the two panels connected to one another will not warp inwardly.

According to a further feature of the invention, the container is of metal and the edge of one panel is folded over the edge of the other panel. In this manner an additional form-fitting connection between the welded panel edges is ensured which results in an increased rigidity of the edge zone and, in particular, prevents deformations thereof during expansion of the container.

It is a further feature of the invention to provide both container panels with deformation-enhancing corrugations arranged in a mirror image with respect to one another. Such an arrangement ensures that in a simple manner particularly large-volume containers may be made from flat panels.

The invention further relates to a container-mounted filler unit which has a tubular nipple closable by a cap and which is adapted particularly for use with deformable containers as outlined above. According to the invention, the tubular nipple is, at its end oriented towards the container, provided with an annular attachment projecting radially into the cross-sectional flow passage area of the tubular nipple and further, the tubular nipple is provided at its free outer end with an inner thread for threadedly receiving an inner ring. A breakable closure disc is tightened, at its marginal zones, by the inner ring against the annular attachment of the tubular nipple.

A filler unit according to the invention as outlined above makes possible to close the containers and to ship the same under sterile conditions. Subsequent to sterilization and filling of the container, the closure disc is placed into the tubular nipple and is tightened by the inner ring screwed into the tubular nipple. This operation too, is effected under sterile conditions. Thereafter, the closure cap is screwed on the tubular nipple, so that the container may be maintained sterile until it is emptied. Even in case of an accidental unscrewing of the closure cap sterile conditions are preserved and, in particular, introduction of foreign bodies into the container is prevented.

According to a particularly advantageous feature of the invention, the closure cap is, on its inside, provided with means for receiving a sterilizing material. Such means may be, for example, an alcohol-impregnated sponge attached to the closure cap. This arrangement ensures that the space between the sealing disc and the closure cap remains sterile during shipment. Such sterilization may also be achieved by loose material positioned in the space between the closure cap and the closure disc.

According to a further feature of the invention, the edge of the annular attachment on the tubular nipple and the edge of the inner ring oriented theretoward form an undercut groove which receives a peripheral clamping bead formed along the circumference of the closure disc. In this manner, the closure disc is form-fittingly received in the tubular nipple, whereby the closure disc is firmly held in the tubular nipple during opening as will be described in detail below.

According to still another feature of the invention, the closure disc, which is preferably made of a synthetic material, has radially extending rupture grooves which reduce the wall thickness of the closure disc. The latter further has hinge grooves extending transversely to the rupture grooves. By virtue of this arrangement it is feasible to couple the pre-sterilized container to a draining device in a closed state and under sterile conditions after removal of the closure cap. Only then will a sterile pressurized fluid, such as $CO_2$ or $N_2$ introduced in a metered manner for pushing the closure disc inwardly, whereby the latter will tear open along the rupture grooves and the remaining parts of the closure disc will pivot inwardly about the hinge grooves. During the subsequent draining of the container, the parts of the ruptured disc may swing outwardly at the hinge grooves. By providing, in the edge zone of the closure disc, hinge grooves which leave a slightly greater wall thickness for the disc body than the rupture grooves, it is ensured that upon tearing open the closure disc no parts thereof can detach and move into the inside of the container.

According to still another advantageous feature of the invention, the outer edge of the hinge grooves extends parallel to the inner ring. In this manner, the outer edge of the hinge grooves has a circular contour which provides that the closure disc may be opened by a cutting device guided along the inner face of the inner ring. It is expedient to guide the cutting device only along one part of the circumference to ensure that the closure disc remains connected, along another part of its circumference, to the tubular nipple with a clamping bead portion.

DESCRIPTION OF THE PREFERRED EMBODIMENTS

Figure 1:
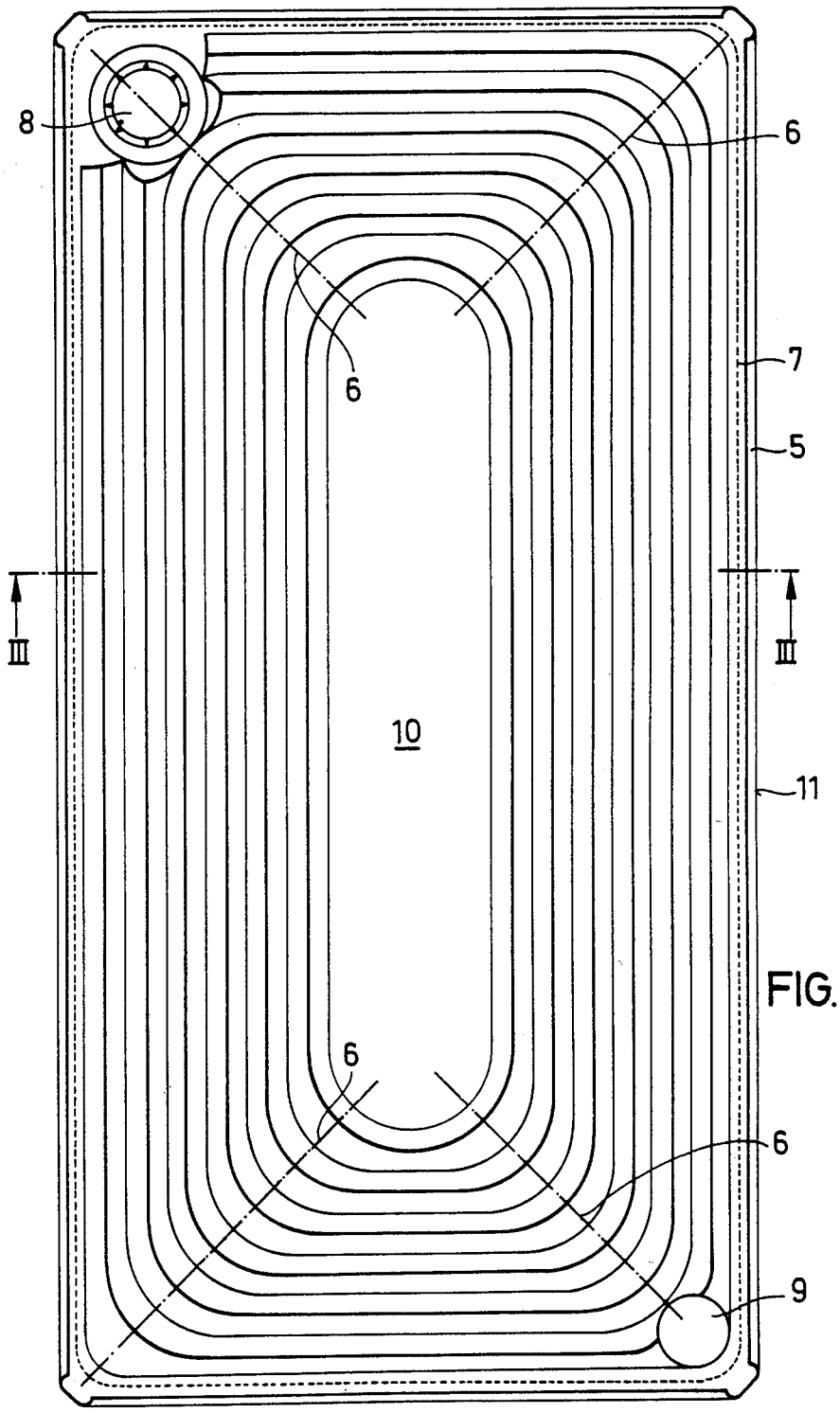
FIG. 1 is a schematic top plan view of a preferred embodiment of the invention in a collapsed state.
Figure 2:
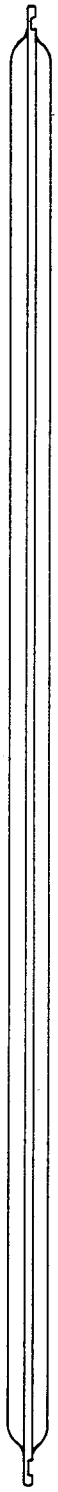
FIG. 2 is a schematic side elevational view of the structure shown in FIG. 1.
Figure 3:
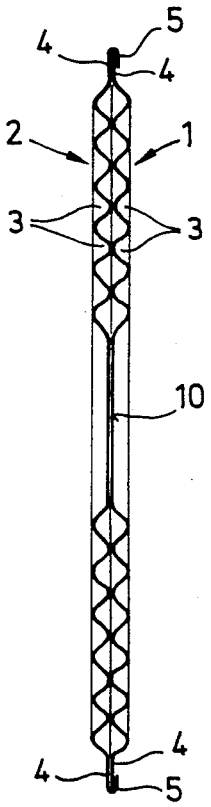
FIG. 3 is a schematic sectional view along line III—III of FIG. 1.

Turning now to FIGS. 1, 2 and 3, there is illustrated a container according to the invention in its state intended for shipment when empty. The container is formed of two superposed, drawable high-grade steel sheet panels 1 and 2. The panels 1 and 2 are provided with a plurality of parallel-extending, deformation-enhancing corrugations 3 arranged as mirror images of one another in the two panels. The panels 1 and 2 are bonded to one another firmly and fluidtight by a weld seam 7 on the face-to-face engaging panel edges 4. The panel 2 has a peripheral edge zone 5 folded over the edge 4 of the panel 1.

The deformation-enhancing corrugations 3 extend appoximately parallel to the contour of the panels. In the zone of the corner diagonals 6 the corrugations 3 are deeper, so that along the zone of the diagonals 6 an increased expansion capacity is available.

The container is, preferably in one corner, provided with a filler unit 8 which will be described later as the specification progresses. At the corner diagonally opposite from the filler unit 8 the panel 1 has a circular flattened part 9 where, if necessary, a breathing opening may be provided.

As particularly well seen in FIGS. 2 and 3, the container occupies in its empty condition only a reduced space and, by virtue of its flat, collapsed configuration, it may be easily stacked and may be inexpensively shipped in large quantities strapped together in a conventional manner.

Prior to filling the container with the intended product, to the filler unit 8 of the still flat, empty container there is attached a hose connected to a fluid pressure source or there is attached the filling hose in a fluidtight manner and the inner space is exposed to the pressurized fluid such as gas, air or liquid or the product itself. As the fluid under pressure enters the container, the latter is, by virtue of its deformation-enhancing corrugated structure inflated (expanded) and assumes a shape illustrated in FIGS. 4, 5 and 6. As seen in FIGS. 5 and 6, the deformation-enhancing corrugations 3 are flattened out and the flat central area 10 of the panels 1 and 2 bulges slightly outwardly. As it may be observed in FIG. 4, in the corner zones the outer edges 11 of the panels are slightly pulled inwardly, whereby the expanded container has a generally cushion-shaped configuration. In case of an edge length of 1200 and 600 mm, of the structure shown in FIG. 1, there is obtained, after expansion of the panels, a container with a capacity of approximately 140 lit. With particular reference to FIG. 6, the containers may be in an upright orientation combined into side-by-side arranged and also superposed groups with appropriate wooden palettes which may be transported with conventional hoisting means such as lifting forks, etc.

The depth of the deformation-enhancing corrugations depends upon the mode of manufacture. In the illustrated embodiment, the individual panels are deep-drawn from a stainless high-grade steel sheet of 0.5 mm thickness. The depth of the corrugations in each panel is approximately 16 mm. Greater corrugation depths may be achieved if, starting from the central area 10, the corrugations are formed in several steps, from the inside outwardly, whereby care should be taken that in each operational step, sufficient material can be pulled in from the edge. By virtue of an appropriately deep design of the deformation-enhancing corrugations even larger container volumes can be obtained with panels of the same outline.

If, during expansion the deformation-enhancing corrugations are not flattened entirely, after emptying of the container the latter may be compressed with a relatively small force so that for the shipment of the empty containers the advantage of a greatly reduced shipping volume is again available.

It is to be understood that instead of metal the container may be made of other materials, for example, synthetic materials which, if shaped appropriately, may be expanded in a similar manner. While containers made of metal can be returned into their collapsed shape only with the application of an appropriate force because of the permanent deformations of metal, in case synthetic materials are used, as a rule, only elastic deformations occur so that upon emptying the container, the latter returns substantially into its flat initial configuration and by virtue of its elastic form-retaining property, it may be re-used after proper cleaning. It is further noted that the invention is not limited to the described rectangular configuration. It is feasible, for example, to use panels which have a square or a circular shape. In the latter case, particularly if appropriately deep deformation-enhancing corrugations are provided, an approximately spherical expanded container may be obtained. If metal, but particularly, if synthetic materials are used for the container, the outer edge of the panels bonded to one another may be provided with an additional reinforcing frame so that the expansion of the empty container does not cause permanent deformations of the edge zones.

Figure 7:
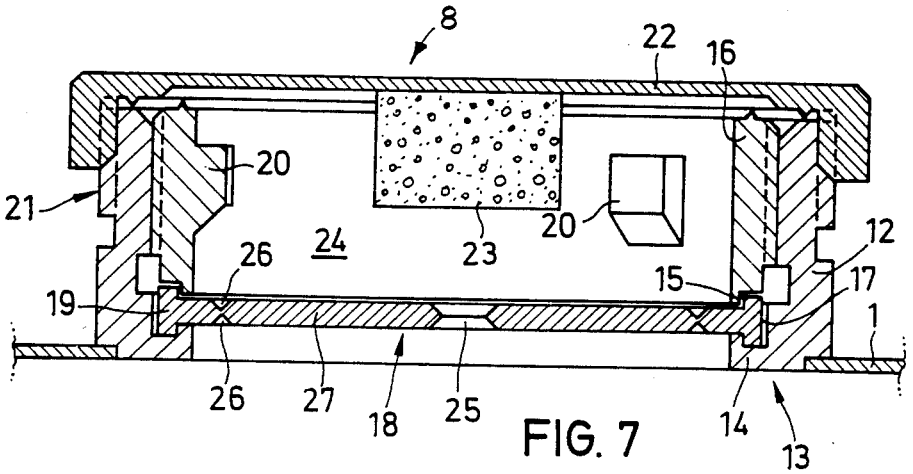
FIG. 7 is an enlarged schematic sectional elevational view of a component shown in FIG. 1.
Figure 8:
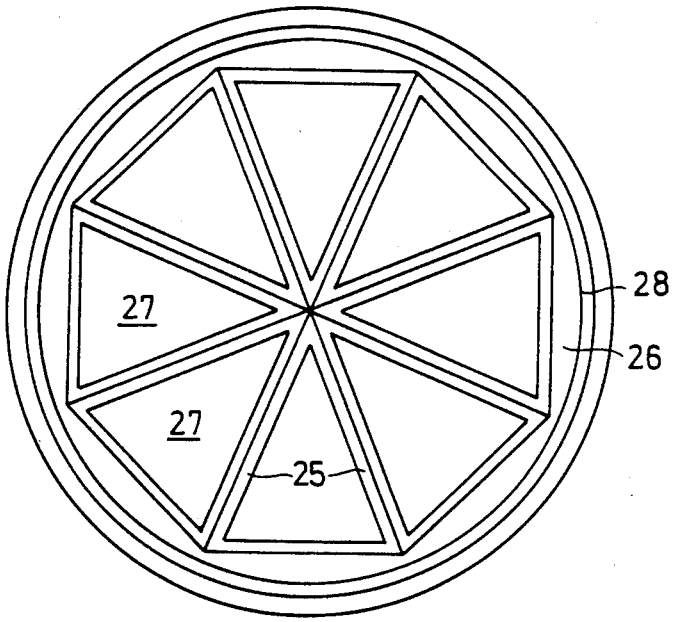
FIG. 8 is a top plan view of a component shown in FIG. 7.

Turning now to FIG. 7, there is shown in axial section and on an enlarged scale a preferred embodiment of a filler unit for particular use with a sterilized container of the above-discussed structure.

The filler unit generally designated at 8 comprises in essence a tubular nipple 12 which is welded into an opening of the panel 1. At its end 13 oriented towards the container, the tubular nipple 12 has a collar (annular attachment) 14 which projects radially inwardly into the flow passage area and which, together with the edge 15 of an inner ring 16 that may be screwed into the tubular nipple 12 from the free end thereof, forms an undercut groove 17. Prior to screwing in the inner ring 16, through the open end of the tubular nipple 12 there is inserted a closure disc 18 whose edge is provided with a peripheral clamping bead 19 which, after screwing in the inner ring 16 is, in a form-fitting manner, held in the groove 17 by the collar 14 and the inner ring 16. At its inner wall the inner ring 16 is provided with lugs 20 for engagement by a wrench or other appropriate turning tool. The tubular nipple 12 is provided at its free end with an external thread 21 which may threadedly engage a closure cap 22. The latter is provided at its inner side with a porous body 23, such as a synthetic sponge which, prior to mounting the closure cap 22 on the tubular nipple 12, is impregnated with a sterilizing means such as alcohol to ensure that the intermediate space 24 between the closure cap 22 and the closure disc 18 remains sterile during the shipment of the container.

Figure 4:
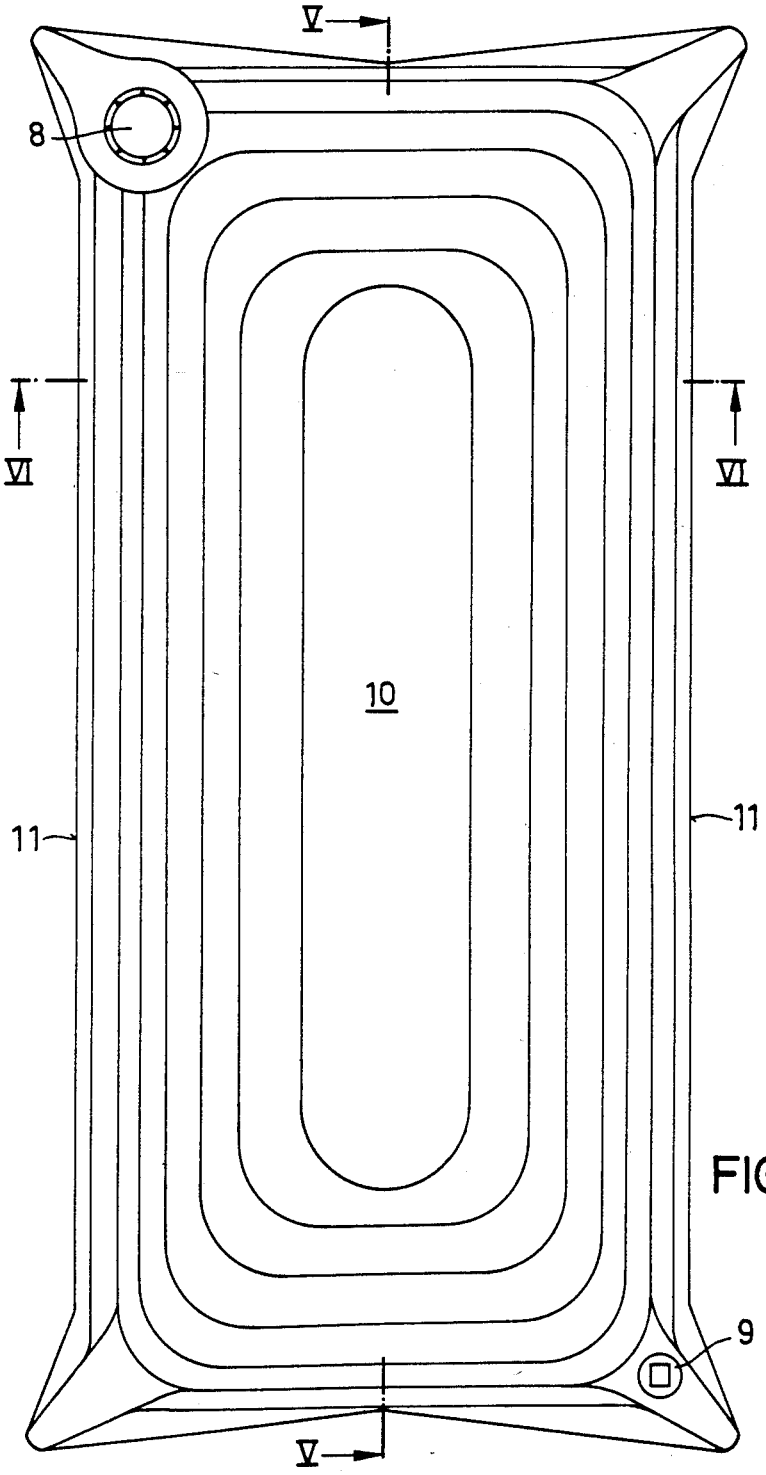
FIG. 4 is a schematic top plan view of the preferred embodiment in an expanded state.
Figure 5:
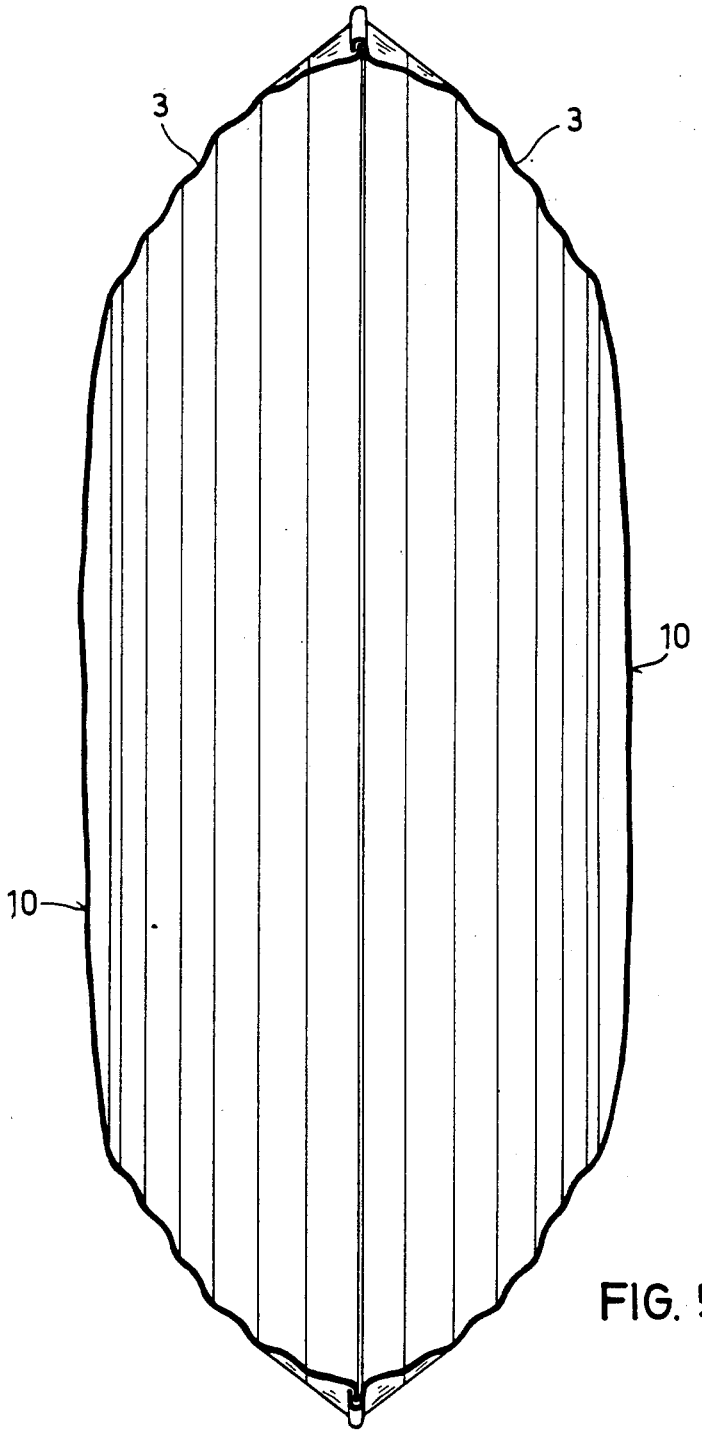
FIG. 5 is a schematic sectional view taken along line V—V of FIG. 4.
Figure 6:
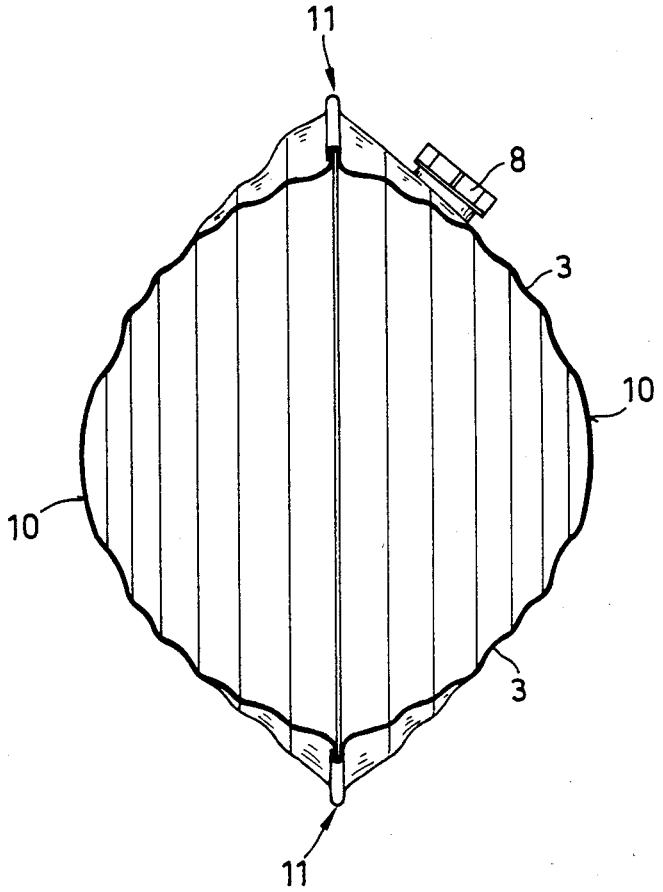
FIG. 6 is a schematic sectional view taken along line VI—VI of FIG. 4.

The closure disc 18 is preferably made of a synthetic material and is inserted into the tubular nipple 12 after the container is sterilized and filled in its deformed (expanded) condition as shown in FIGS. 4 and 5. In order tp preserve the sterile conditions even during the emptying of the container, the closure disc 18 is not disassembled from the tubular nipple but is ruptured as an emptying device is joined thereto. For this purpose, the closure disc 18 is designed as a rupture disc, that is, it tears open as it is exposed by a metered pressure medium.

In order to ensure that after the closure disc is ruptured, fragments thereof do not enter the inner space of the container, the closure disc 18 are relatively thick walls and radially extending rupture grooves 25 which weaken the wall. In the edge zone of the closure disc 18 there are provided hinge grooves 26 which extend transversely to the rupture grooves 25 and whose depth is so designed that as pressure is applied on the closure disc 18, the latter tears along the rupture grooves 25 while the remaining thick-walled intermediate parts 27 pivot about the respective hinge grooves 26 inwardly, thus remaining firmly secured to the continuous edge zone of the closure disc 18.

In order to ensure that a closure disc as described above may also be opened with a cutting device expediently guided circularly and coaxially with the axis of the tubular nipple 12, the outer edge 28 of the hinge grooves 26 has a circular contour which is parallel to the inner ring 16, so that a cutting device may be guided through the relatively thin wall of the closure disc 18 in the zone along the outer edge 28.

It will be understood that the above description of the present invention is susceptible to various modifications, changes and modifications, and the same are intended to be comprehended within the meaning and range of equivalents of the appended claims.

What is claimed is:

1. In a container made of deformable sheet material, having two panels generally facing one another and having perimetric edge portions bonded fluidtight to one another; the perimetric edge portions of one of said panels being folded over perimetric edge portions of the other of said panels; the improvement comprising deformation-enhancing corrugations provided in at least one of said panels whereby said container is expandable from a flat state into an inflated state; said one panel including a perimeter and said corrugations extending approximately parallel to said perimeter; said sheet material of at least said one panel being a drawable metal; and filler means provided in one of said panels for allowing a fluid to be introduced into and to be withdrawn from said container.

2. A container as defined in claim 1, wherein said container has a quadrilateral rectangular outline defining corner zones; said corrugations having, in said flat state, a depth greater in said corner zones than externally thereof.

3. A container as defined in claim 1, further wherein both said panels are provided with deformation-enhancing corrugations and further wherein the corrugations provided in one of said panels are arranged as a mirror image of the corrugations provided in the other of said panels.

4. An container is defined in claim 1, wherein said drawable metal is a high-grade steel.

* * * * *